US008382606B2

(12) United States Patent
Franklin et al.

(10) Patent No.: US 8,382,606 B2
(45) **Date of Patent: *Feb. 26, 2013**

(54) STRUCTURE OF A GOLF CLUB HEAD OR OTHER BALL STRIKING DEVICE

(75) Inventors: David N. Franklin, Granbury, TX (US); John T. Stites, Weatherford, TX (US); Gary G. Tavares, Azle, TX (US)

(73) Assignee: Nike, Inc., Beaverton, OR (US)

( * ) Notice: Subject to any disclaimer, the term of this patent is extended or adjusted under 35 U.S.C. 154(b) by 108 days.

This patent is subject to a terminal disclaimer.

(21) Appl. No.: 12/985,841

(22) Filed: Jan. 6, 2011

(65) Prior Publication Data

US 2011/0094082 A1 Apr. 28, 2011

Related U.S. Application Data

(63) Continuation of application No. 12/652,592, filed on Jan. 5, 2010, now Pat. No. 7,867,104, which is a continuation of application No. 12/122,095, filed on May 16, 2008, now Pat. No. 7,670,232, which is a continuation of application No. 10/934,742, filed on Sep. 7, 2004, now Pat. No. 7,407,443.

(51) Int. Cl.
*A63B 69/36* (2006.01)
*A63B 53/04* (2006.01)

(52) U.S. Cl. ..... 473/251; 473/255; 473/224; 473/334; 473/340; 473/341; 473/349; 473/409

(58) Field of Classification Search ..... 473/324–350, 473/287–292, 244–256, 409; D21/736–746
See application file for complete search history.

(56) References Cited

U.S. PATENT DOCUMENTS

| | | | |
|---|---|---|---|
| 4,010,958 | A | 3/1977 | Long |
| 4,121,832 | A | 10/1978 | Ebbing |
| 4,121,833 | A | 10/1978 | Prueter |
| 4,508,350 | A | 4/1985 | Duclos |
| 4,693,478 | A | 9/1987 | Long |
| 4,979,744 | A | 12/1990 | Alcala |
| 5,058,895 | A | 10/1991 | Igarashi |
| 5,078,398 | A | 1/1992 | Reed et al. |
| 5,080,365 | A | 1/1992 | Winchell |
| 5,197,737 | A | 3/1993 | Desbiolles et al. |

(Continued)

FOREIGN PATENT DOCUMENTS

| | | |
|---|---|---|
| JP | 2002-224253 | 8/2002 |
| JP | 2003-210629 | 1/2003 |

(Continued)

OTHER PUBLICATIONS

Dec. 16, 2011 Office Action issued in related Chinese Application No. 200580034318.0.

(Continued)

*Primary Examiner* — Sebastiano Passaniti
(74) *Attorney, Agent, or Firm* — Banner & Witcoff, Ltd.

(57) ABSTRACT

Ball striking devices, such as golf club heads (including putter heads), have a high moment of inertia about their center, to help prevent twisting and mis-hits, particularly when the ball striking device hits the ball at a somewhat off-center position. The ball striking head of the ball striking device may be structured and/or weighted (optionally with separately attachable weight elements) to have a moment of inertia about a center of the ball striking surface of at least 10,000 g/cm$^2$, and in some examples, the moment of inertia may be at least 11,000 g/cm$^2$, or even at least 12,000 g/cm$^2$. In some examples, the moment of inertia may be at least 20,000 g/cm$^2$, or even at least 25,000 g/cm$^2$ or at least 28,000 g/cm$^2$.

19 Claims, 6 Drawing Sheets

U.S. PATENT DOCUMENTS

| | | | | |
|---|---|---|---|---|
| 5,494,282 | A | 2/1996 | Pranio | |
| 5,690,562 | A | 11/1997 | Sturm | |
| 5,749,790 | A | 5/1998 | Van Alen, II et al. | |
| 5,820,481 | A | 10/1998 | Raudman | |
| 6,350,208 | B1 | 2/2002 | Ford | |
| 6,488,594 | B1 | 12/2002 | Card et al. | |
| D477,041 | S | 7/2003 | Cameron | |
| 6,663,497 | B2 | 12/2003 | Cameron | |
| 6,796,911 | B2 | 9/2004 | Grace | |
| D507,613 | S | 7/2005 | Baiocchi | |
| 6,988,956 | B2 | 1/2006 | Cover et al. | |
| 7,004,849 | B2 | 2/2006 | Cameron | |
| D520,584 | S | 5/2006 | Karlsen | |
| 7,048,646 | B2 | 5/2006 | Yamanaka et al. | |
| 7,163,469 | B2 | 1/2007 | Bonneau | |
| 7,407,443 | B2 | 8/2008 | Franklin et al. | |
| 7,438,648 | B2 | 10/2008 | Wahl et al. | |
| D584,780 | S | 1/2009 | Ines et al. | |
| D587,326 | S | 2/2009 | Ines et al. | |
| 7,491,131 | B2 | 2/2009 | Vinton | |
| 7,648,425 | B2 | 1/2010 | Wahl et al. | |
| 7,670,232 | B2 | 3/2010 | Franklin et al. | |
| 7,867,104 | B2 * | 1/2011 | Franklin et al. | 473/251 |
| 2001/0029209 | A1 | 10/2001 | Kosovac | |
| 2002/0098912 | A1 | 7/2002 | Anderson et al. | |
| 2002/0193176 | A1 | 12/2002 | Grace | |
| 2003/0073509 | A1 | 4/2003 | Kosovac et al. | |
| 2003/0228925 | A1 | 12/2003 | Rohrer | |
| 2004/0063516 | A1 | 4/2004 | Cameron | |
| 2005/0137027 | A1 | 6/2005 | Thomas | |
| 2007/0155524 | A1 | 7/2007 | Cameron | |
| 2007/0213141 | A1 | 9/2007 | Jones | |
| 2007/0243950 | A1 | 10/2007 | Billings | |

FOREIGN PATENT DOCUMENTS

| | | |
|---|---|---|
| JP | 2004-008682 | 1/2004 |
| JP | 3099312 | 4/2004 |

OTHER PUBLICATIONS

Feb. 20, 2012 Office Action issued in related Japanese Application No. 2009-292055.

Mar. 19, 2012 Office Action issued in related Japanese Application No. 2011-032174.

May 17, 2011 Office Action issued in related European Application No. 05784319.5.

Aug. 6, 2010 Office Action issued in related Chinese Application No. 200580034318.0.

Apr. 2, 2009 Office Action issued in related Japanese Application No. 2007-529909.

International Search Report issued in related PCT/US2005/028512 mailed Mar. 15, 2006.

Sep. 22, 2008 Office Action issued in related Korean Application No. 10-2008-7015367.

Jul. 1, 2009 Office Action issued in related Korean Application No. 10-2008-7015367 (English Translation only).

Apr. 24, 2008 Office Action issued in related Korean Application No. 10-2007-7006862.

Aug. 24, 2009 Office Action issued in related Japanese Application No. 2007-529909.

May 22, 2009 Office Action issued in related Chinese Application No. 200580034318.0.

Letters Patent issued on Mar. 16, 2010 in related Korean Application No. 10-2008-7015367.

Apr. 28, 2009 Office Action issued in related European Application No. 05784319.5.

International Preliminary Report on Patentability and Written Opinion issued in related PCT/US2005/028512 mailed Mar. 22, 2007.

Xtreme Heads—Xtreme Moment Putter Head 01 & 02 printout, copyright 2004.

Feb. 22, 2010 Pre-Appeal Examination Report issued in related Japanese Application No. 2007-529909.

Jul. 28, 2010 Questioning issued in related Japanese Application No. 2007-529909.

Letters Patent issued on Oct. 7, 2008 in related Korean Application No. 10-2007-7006862.

Aug. 29, 2012 Office Action issued in U.S. Appl. No. 12/987,632.

JP Decision of Rejection (with translation) dated Oct. 3, 2012 for JP Application No. 2009-292055.

JP Decision of Rejection (with translation) dated Oct. 10, 2012 for JP Application No. 2011-032174.

* cited by examiner

STRUCTURE OF A GOLF CLUB HEAD OR OTHER BALL STRIKING DEVICE

RELATED APPLICATION DATA

This application is a continuation of co-pending U.S. patent application Ser. No. 12/652,592 filed Jan. 5, 2010 entitled "Structure of a Golf Club Head or Other Ball Striking Device", which is a continuation of U.S. patent application Ser. No. 12/122,095 (now U.S. Pat. No. 7,670,232), filed on May 16, 2008 entitled "Structure of a Golf Club Head or Other Ball Striking Device", which is a continuation of U.S. patent application Ser. No. 10/934,742 (now U.S. Pat. No. 7,407,443), filed on Sep. 7, 2004 entitled "Structure of a Golf Club Head or Other Ball Striking Device", the contents of which are entirely incorporated herein by reference.

FIELD OF THE INVENTION

The invention relates generally to ball striking devices, such as golf club heads (including putter heads) that have a high moment of inertia about their center impact locations, to help prevent club head twisting and mis-hits, particularly when the ball striking device hits the ball at a position somewhat off-center from the center impact location.

BACKGROUND

Golf is enjoyed by a wide variety of players—players of different genders, and players of dramatically different ages and skill levels. Golf is somewhat unique in the sporting world in that such diverse collections of players can play together in golf events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golf's popularity in recent years, both in the United States and across the world. The number of individuals participating in the game and the number of golf courses have increased steadily over recent years.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. To reliably fly straight and in the desired direction, a golf club must meet the golf ball square (or substantially square) to the desired target path. Moreover, the golf club must meet the golf ball at or close to a desired location on the club head face (i.e., on or near the "sweet spot") to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from square and/or is located away from the club's "sweet spot," even by a relatively minor amount, also can launch the golf ball in the wrong direction, often with undesired hook or slice spin, and/or can rob the shot of distance. Accordingly, club head structures that can help a user keep the club face square through the contact zone and/or resist twisting during the swing and/or at contact would tend to help the ball fly straighter and truer, in the desired direction, and often with improved and/or reliable distance.

Like other golf clubs, putters also must make square contact with the golf ball, in the desired direction or path, in order to produce straight and true rolls in the desired direction. If the putter head twists during the stroke, this will tend to send the ball off-line and/or decrease the distance the putt travels. Additionally, off-center hits on the putter's face (i.e., hits away from the putter's "sweet spot") will tend to cause the putter head to twist when it contacts the ball, which again tends to send the ball off-line and/or decrease the roll distance. Accordingly, putter head structures that can help users keep the club face square to the target line through the contact zone and/or prevent the club head from twisting during the swing and/or at contact will tend to help the ball roll straighter, truer, and in the desired direction.

SUMMARY

The following presents a general summary of aspects of the invention in order to provide a basic understanding of at least some of its aspects. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to ball striking devices, such as golf club heads (including putter heads) that have a high moment of inertia about their center impact locations, to help prevent twisting and mis-hits, particularly when the ball striking device hits the ball at a somewhat off-center position.

One more specific aspect of this invention relates to ball striking devices that include: (a) a first member (e.g., a body member) having a first surface that faces a ball in use, a second surface opposite the first surface, wherein an opening is defined in the second surface, and a base member extending in a direction away from the second surface; and (b) a second member (e.g., an insert member) including an insert portion received in the opening defined in the first member, wherein the second member further includes a body portion that extends in a direction away from the insert portion, and wherein the body portion defines at least one open area. An additional or alternative aspect of the invention relates to ball striking devices, such as golf clubs, putters, and the like, that include: (a) a first member (e.g., a body member) having a first surface that, at least in part, defines a ball striking surface that faces a ball in use; and (b) a second member (e.g., an insert member) attached with the first member, wherein the second member includes a body portion that extends in a direction away from the first member, and the body portion defines at least one open area. The ball striking device according to aspects of the invention may include a ball striking head that includes the ball striking surface, wherein the ball striking head has a moment of inertia about a center of the ball striking surface of at least 10,000 g/cm$^2$, and in some examples, the moment of inertia may be at least 11,000 g/cm$^2$, or even at least 12,000 g/cm$^2$.

Additional aspects of the invention relate to ball striking devices, such as golf club heads (e.g., putter heads) that include: (a) a ball striking surface; and (b) a body member extending in a direction away from the ball striking surface. Golf club heads according to these examples of the invention have a moment of inertia about a center of the ball striking surface of at least 20,000 g/cm$^2$, and in some examples at least 25,000 g/cm$^2$, or even at least 28,000 g/cm$^2$. Reaching these moment of inertia specifications can be accomplished in various ways without departing from the invention. For example, the body member and/or the ball striking surface and/or the ball striking portion of the club head may be formed of a lightweight material, such as aluminum, titanium, polymeric materials, and the like. As another example, weighted members (e.g., lead or tungsten weights) may be provided, for example, behind the ball striking portion and/or around an outer perimeter of the golf club head. In some more specific examples, one or more weighted members may be provided behind the ball striking surface and at least partially outside a plane oriented perpendicular to the ball striking surface and located at an end of the ball striking surface. If desired, in at least some examples, the body member, the ball striking surface, and/or the ball striking portion of the club head may be made from polymeric material, optionally with one or more of these elements provided as a unitary, one-piece construction.

Still additional aspects of the invention relate to methods for constructing or assembling ball striking devices, e.g., of the type described above, such as golf club heads, putter heads, golf clubs, putters, and the like. One such method may include: (a) providing a first member (e.g., a body member) including a first surface that faces a ball in use, a second surface defining an opening, and a base member extending in a direction away from the first surface; (b) inserting an insert portion of a second member into the opening defined in the first member, wherein the second member further includes a body portion that extends in a direction away from the insert portion, wherein the body portion defines at least one open area; and (c) securing the first member and the second member to one another (either directly or indirectly). An additional or alternative method according to at least some examples of this invention includes: (a) providing a first member (e.g., a body member) including a first surface that, at least in part, defines a ball striking surface that faces a ball in use; and (b) securing a second member with the first member, wherein the second member includes a body portion that extends in a direction away from the first member, wherein the body portion defines at least one open area, wherein the first member and the second member, at least in part, form a ball striking device. Again, the ball striking device may include a ball striking head that includes the ball striking surface, wherein the ball striking head has a moment of inertia about a center of the ball striking surface of at least 10,000 g/cm$^2$. In some examples, the moment of inertia may be at least 11,000 g/cm$^2$, or even at least 12,000 g/cm$^2$. Some moments of inertia may be greater than 12,000 g/cm$^2$, as described above.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein.

DETAILED DESCRIPTION

Figure 1:
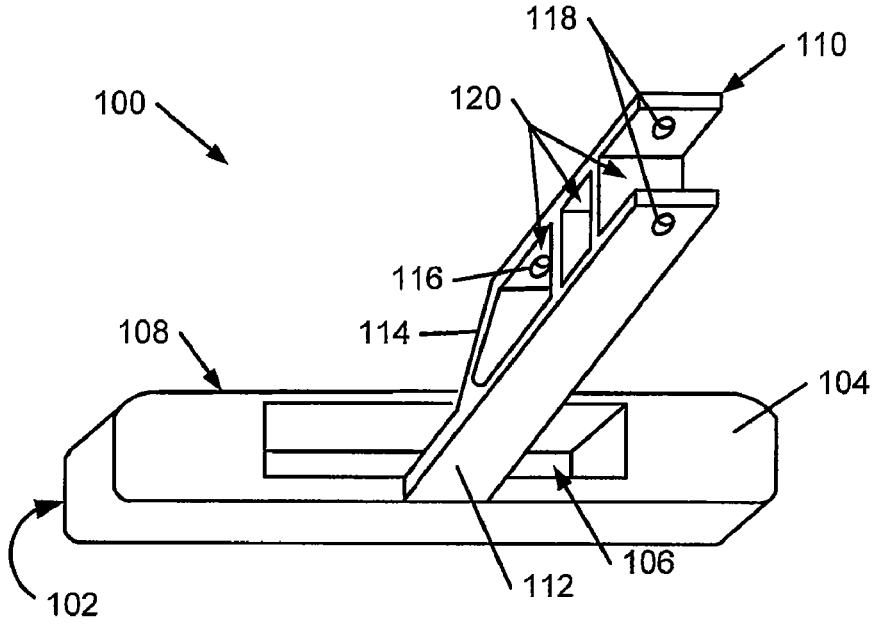
FIG. 1 illustrates a ball striking device body member according to an example of this invention.

In the following description of various example embodiments of the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

To assist the reader, this specification is broken into various subsections, as follows: Terms; General Description of Ball Striking Devices According to the Invention; Specific Examples of the Invention; and Conclusion.

A. Terms

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device that contacts the ball (or other object) in use. In some examples, such as golf clubs, the ball striking head may be a separate entity from any shaft or handle member, and it may be bonded to the shaft or handle in some manner.

The terms "shaft" and "handle" are used synonymously and interchangeably in this specification, and they include the portion of a ball striking device (if any) that the user holds during a swing of a ball striking device.

B. General Description of Ball Striking Devices According to the Invention

In general, aspects of this invention relate to ball striking devices, such as golf clubs, putters, golf club heads, putter heads, and the like. Ball striking devices according to at least some examples of the invention may include: (a) a first member (e.g., a body member) having a first surface that faces a ball in use, a second surface opposite the first surface, wherein an opening is defined in the second surface, and a base member extending in a direction away from the second surface; and (b) a second member (e.g., an insert member) including an insert portion received in the opening defined in the first member, wherein the second member further includes a body portion that extends in a direction away from the insert portion, and the body portion defines at least one open area. Additionally or alternatively, aspects of the invention relate to ball striking devices, such as golf clubs, putters, golf club heads, putter heads, and the like, that may include: (a) a first member (e.g., a body member) having a first surface that, at least in part, defines a ball striking surface that faces a ball in use; and (b) a second member (e.g., an insert member) attached with the first member, wherein the second member includes a body portion that extends in a direction away from the first member, and the body portion defines at least one open area. The ball striking device according to at least some aspects of the invention may include a ball striking head that includes the ball striking surface, wherein the ball striking head has a moment of inertia about a center of the ball striking surface of at least 10,000 g/cm$^2$, and in some examples, the moment of inertia may be at least 11,000 g/cm$^2$, or even at least 12,000 g/cm$^2$.

In at least some examples of the invention, the opening in the first member may extend completely through the first member such that the insert portion of the second member is exposed through the first surface of the first member at one or more locations. In this manner, a surface of the insert portion of the second member may form at least a portion of the ball striking surface. Optionally, the first surface of the first member and a first surface of the insert portion will lie flush or substantially flush with one another when the ball striking device is fully assembled.

The structure of various portions of the ball striking device may be designed or modified to assist in attaining the moment of inertia characteristics identified above. For example, in at least some examples of the invention, the body portion of the second member (e.g., the insert-containing member) may be generally triangular or trapezoidal shaped and oriented such that a base side of the triangular or trapezoidal shaped body portion is located behind the ball striking surface and extends parallel or substantially parallel to the ball striking surface. If desired, one or more weighted members may be mounted on the ball striking device, e.g., behind the ball striking surface at corner region(s) of the triangular or trapezoidal shaped body portion's base side. The weighted member(s) may be selectively removable from the ball striking device's structure (e.g., from the body portion), e.g., so that users, club fitters, and the like can interchange one weight for another or remove weights, to change the swing characteristics of the ball striking device and thereby customize the device to their likings and preferences.

Additional aspects of the invention relate to methods for constructing or assembling ball striking devices, e.g., of the type described above, such as golf club heads, golf clubs, putter heads, putters, and the like. Such methods may include, for example: (a) providing a first member (e.g., a body member) including a first surface that faces a ball in use, a second surface defining an opening, and a base member extending in a direction away from the first surface; (b) inserting an insert portion of a second member into the opening defined in the first member, wherein the second member further includes a body portion that extends in a direction away from the insert portion, wherein the body portion defines at least one open area; and (c) securing the first member and the second member to one another.

Additional methods according to at least some examples of this invention relate to methods for constructing or assembling ball striking devices, e.g., of the type described above, that may include: (a) providing a first member (e.g., a body member) including a first surface that, at least in part, defines a ball striking surface that faces a ball in use; and (b) securing a second member with the first member, wherein the second member includes a body portion that extends in a direction away from the first member and wherein the body portion defines at least one open area. The first member and the second member, at least in part, form a ball striking device, wherein the ball striking device includes a ball striking head that includes the ball striking surface, wherein the ball striking head has a moment of inertia about a center of the ball striking surface of at least 10,000 g/cm$^2$. In some examples, the moment of inertia may be at least 11,000 g/cm$^2$, or even at least 12,000 g/cm$^2$.

When inserted into the first member through the opening provided therein, the insert portion of the second member may be exposed through the first surface of the first member, and thereby may form, at least in part, the ball striking surface of the ball striking device. The second member further may include a triangular or trapezoidal shaped body portion of the type generally described above (and described in more detail below).

Additional aspects of methods according to the invention may include attaching at least one weighted member to the ball striking device's structure to help set, control, and/or modify the moment of inertia associated with the ball striking device. The weighted member may be attached at any desired location to the ball striking device, such as to the body portion of the second member. As noted above, the weighted member (s) may be removably attachable to some portion of the ball striking device, e.g., to allow users, club fitters, or the like to freely change and customize the device's swing characteristics e.g., to suit a user's swing characteristics and/or preferences, to suit particular play conditions (e.g., fast greens v. slow greens, wet conditions v. dry conditions, etc.), etc. In additional examples, a handle (or shaft) may be attached to at least one of the first member or the second member.

Still additional aspects of this invention relate to ball striking devices, such as golf club heads (including putter heads) that include: (a) a ball striking surface; and (b) a body member extending in a direction away from the ball striking surface. In such examples of the invention, the golf club head may have a moment of inertia about a center of the ball striking surface of at least 20,000 g/cm$^2$, or in some examples at least 25,000 g/cm$^2$, or even at least 28,000 g/cm$^2$. These moment of inertia specifications may be reached in various ways without departing from the invention. For example, the body member and/or the ball striking surface and/or a ball striking portion of the club head that includes the ball striking surface may be formed of a lightweight material, such as aluminum, titanium, polymeric materials, and the like. As another example, weighted members (e.g., lead or tungsten weights) may be provided, for example, behind the ball striking portion and/or around an outer perimeter of the golf club head. In some more specific examples, one or more weighted members may be provided behind the ball striking surface and at least partially outside a plane oriented perpendicular to the ball striking surface and located at an end of the ball striking surface. If desired, in at least some examples, the body member, the ball striking surface, and/or the ball striking portion of the club head may be made from polymeric material, optionally with one or more of these parts provided as a unitary, one-piece construction Specific examples of the invention are described in more detail below. The reader should understand that these specific examples are set forth merely to illustrate examples of the invention, and they should not be construed as limiting the invention.

C. Specific Examples of the Invention

The various figures in this application illustrate examples of ball striking devices useful in systems and methods according to examples of this invention. When the same reference number appears in more than one drawing, that reference number is used consistently in this specification and the drawings to refer to the same or similar parts throughout.

At least some example embodiments of ball striking devices according to this invention relate to golf club head structures, including putter heads. Such devices may include at least a two piece construction and structure. A first example structure of a ball striking device according to this invention will be described in detail below in conjunction with FIGS. 1-5.

FIG. 1 illustrates an example of one piece of a golf club head structure useful in accordance with at least some examples of this invention. This first structural member 100 (also called a "body member" in this specification) includes a first surface 102 that faces a golf ball (or other ball) when the club head is in use (this first surface 102 is not visible in the view shown in FIG. 1, but it can be seen in FIG. 4). The body member 100 in this illustrated example essentially is rectangular cubic shaped such that a second surface 104 is located opposite the first surface 102. Of course, a wide variety of sizes, shapes, and orientations of body member 100 may be used without departing from the invention.

The second surface 104 of this example structure 100 has an opening 106 defined therein. Opening 106 in this example structure extends completely through the body member 100, from the second surface 104 to the first surface 102. In other examples, if desired, the opening 106 need not extend all of the way through the club head portion of body member 100. For example, if desired, the opening 106 could begin at surface 104 and extend part way through the club head portion of body member 100 but terminate before it reaches the first surface 102. As another example, if desired, the opening 106 may be provided in the top surface 108 or another surface of the club head portion of the body member 100 without departing from the invention. As still another example, if desired, in some structures, no opening will be required (e.g., the insert member 200 may be integrally formed with or attached to the body member 100 in some manner).

The body member 100 of this example structure further includes a base member 110 that extends in a direction behind the club head face and away from the first surface 102 and the second surface 104. The base member 110 may take on a wide variety of different structures and shapes without departing from the invention. In the illustrated example, the base member 110 includes a lowered flat region 112 immediately adjacent the opening 106 to provide easy access to the opening 106 (for reasons that will become more apparent in the description to follow). From the lowered flat region 112, the base member 110 forms an angled portion 114 that extends back away from the club head portion of the body member 100 and upward, and then the base member 110 of this example structure further provides a handle or shaft mounting system 116. Any suitable or desired manner of mounting a shaft or handle to the club head body member 100 may be used without departing from the invention, including conventional manners known in the art. For example, a shaft may be screwed or threaded into a suitable receptacle region 116 on the base member 110, it may be secured via adhesives, mechanical connectors, and/or the like.

The base member 110 of this example structure extends back further and provides a securing region 118. The securing region 118 is used in this example structure to secure the body member 100 to another portion of the overall club head structure, as will be described in more detail below.

The base member 110 may be included as part of the club head portion of the body member 100 in any suitable or desired manner without departing from the invention. For example, the entire structure 100 may be a unitary, one-piece construction, e.g., formed by casting, forging, molding, machining, etc. As another example, the base member 110 may be welded, soldered, press fit, inserted into, and/or otherwise attached to the club head portion of the body member 100. The base member 110 and the club head portion of the body member 100 may be made from any suitable or desired material without departing from the invention, including conventional materials known in the art. Examples of suitable materials include: aluminum, titanium, steel, brass, pewter, carbon fiber, polymers, etc.

Also, the base member 110 may be attached or included as part of the club head portion of the body member 100 at any desired position without departing from the invention. In the illustrated example, the base member 110 extends from the bottom center of the club head, below opening 106. Alternatively, if desired, as additional examples, the base member 110 may extend from the top of the club head (above opening 106), from the top surface 108, from along one or both sides of the opening 106, from the side surfaces of the club head portion, and/or from any other desired location without departing from the invention. As another example, the base member 110 may extend from the insert portion 200, which is described in more detail below in conjunction with FIG. 2. In still other examples, no base member 110 is required in the overall body member structure 100.

Notably, the base member 110 in this example has a very open-cell or "truss-like" structure, with open areas 120 defined in it at various locations. These open areas 120 help reduce the overall weight of the base member 110, which allows additional weight to be distributed elsewhere in the overall club head structure, while still maintaining an overall strong and stable structure and avoiding an excessively heavy structure. The material(s) making up the body member 100, including the base member 110, also may be selected so as to avoid creating an excessively heavy club head structure. The potential re-distribution of weight in the overall club head structure will be described in more detail below.

Figure 2:
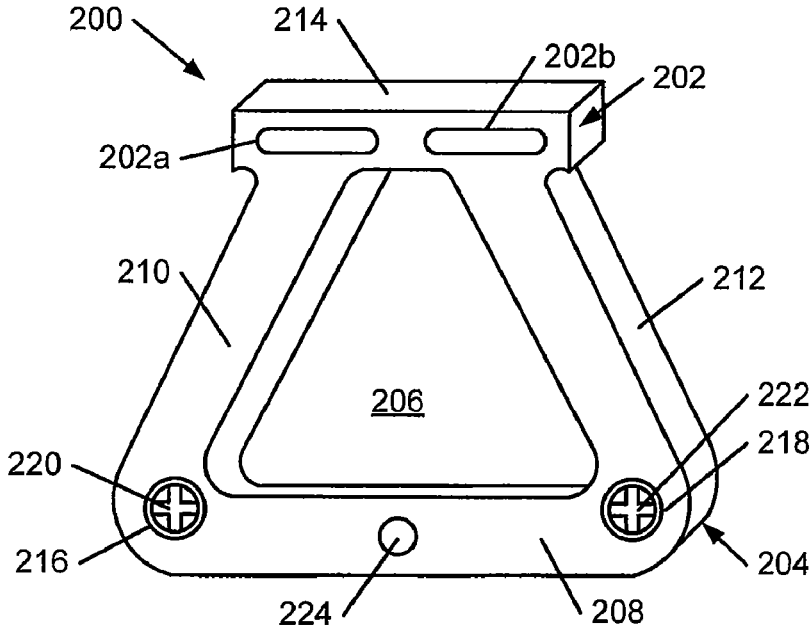
FIG. 2 illustrates a ball striking device insert member according to an example of this invention.

FIG. 2 illustrates an example of a second piece of a ball striking device (a putter head, in this illustrated example) in accordance with examples of this invention. This second member 200 (also called an "insert member" in this specification) includes an insert portion 202 that is sized and shaped so as to be received in the opening 106 defined in the body member 100 (e.g., press fit into the opening 106). The insert member 200 further includes a body portion 204 that extends in a direction away from the insert portion 202. The insert portion 202 and the body portion 204 may be of a unitary, one-piece construction, or alternatively, if desired, the insert portion 202 may be separate from and fitted to the body portion 204 in any desired manner without departing from the invention, such as via welding, soldering, adhesives, mechanical connections, inserts, press fitting, and the like. Moreover, the insert member 200, including the insert portion 202 and the body portion 204, may be formed of any suitable or desired materials without departing from the invention, including conventional materials known in the art. As more specific examples, the various portions of insert member 200 may be constructed from one or more of: aluminum, titanium, steel, brass, pewter, carbon fiber, polymers, etc.

The insert member 200, including the insert portion 202 and/or the body portion 204, may take on any desired shape or form without departing from the invention. In at least some examples of the invention, the body portion 204 will be constructed and shaped so as to form an open area 206. In this illustrated example, the body portion 204 is triangular shaped including a base side 208 and two side arms 210 and 212, wherein open area 206 is defined between the base side 208 and the side arms 210 and 212. The base side 208, in this example, extends in a direction parallel to (or substantially parallel) to a front surface 214 of the insert portion 202 (and it will extend parallel to (or substantially parallel to) the front surface 102 of base member 100, when the insert member 200 is joined with base member 100). Of course, any desired arm lengths, arm widths, arm thicknesses, base side lengths, base side thicknesses, relative arm angles, and the like may be used in the insert member 200 without departing from the invention. Also, shapes other than the generally triangular shape shown in FIG. 2 may be used for the insert member 200 without departing from the invention, such as rectangular shaped, elliptical-shaped, round-shaped, trapezoidal-shaped, etc.

The open area 206 helps reduce the overall weight of the insert member 200. To further reduce the weight of the insert member 200, if necessary or desired, interior portions of its structure (e.g., its arms 210 and 212 or base side 208) may be hollowed out or formed into an open-cell or "truss-like" structure, e.g., similar to the structure for the base member 110 shown in FIG. 1. As still another example, the insert portion 202 is shown in FIG. 2 as including two cut out or hollowed out regions 202*a* and 202*b* that extend completely through the insert portion 202 (if desired, they could partially extend through the insert portion 202). Of course, such cut out or hollowed out regions may be provided along the side arms 210 and 212 and/or along the base side 208 without departing from the invention. Also, if desired, the material(s) for constructing the insert member 202 may be selected so as to control the overall weight of the device.

The cut out or hollowed out regions 202*a* and 202*b*, as well as the open area 206 and the open cell structure 120 of the base member 110, as well as the materials used to make up these elements (e.g., lightweight materials, such as aluminum, titanium, polymeric materials, etc.), help reduce the overall weight of the entire club head, and it enables club makers and designers to apply additional weight at other locations in the overall club head structure, without excessively increasing the club head's total weight. Weight distribution and control of this type allows one to change and/or control the swing characteristics of the overall club head. Any desired way of redistributing and/or weighting the club head may be used without departing from the invention. For example, the insert member 200 may include receptacles 216 and 218 for receiving weighted members, 220 and 222, respectively, such as weighted inserts made of lead, tungsten, or other heavy metals or materials. If desired, the weighted members 220 and 222 may be removably mounted to the insert member 200, e.g., by removable adhesives, threads, turnbuckles, clamps, clasps, set screws, or other mechanical connections, so that the weighted members 220 and 222 may be easily removed from their receptacles 216 and 218, interchanged for other weighted members, etc. This feature enables customization of the swing characteristics of the overall club head to better suit an individual user's swing characteristics, preferences, and the like.

The receptacles 216 and 218 (and hence the weighted inserts 220 and 222) may be provided at any desired location on the overall club head structure without departing from the invention. In at least some examples of the invention, as illustrated in FIG. 2, the receptacles 216 and 218 are located on the insert member 200, and even more particularly, on the body portion 204 of the insert member 200, e.g., at a location remote from the insert portion 202 and/or away from the center of the ball striking surface. Using the triangular shaped body portion 204 shown in FIG. 2, the weighted member receptacles 216 and 218 (and hence the weighted members 220 and 222 themselves) may be located at the corner regions of the triangular shaped body portion 204, generally at the location where the base side 208 meets each of the side arms 210 and 212.

Figure 3:
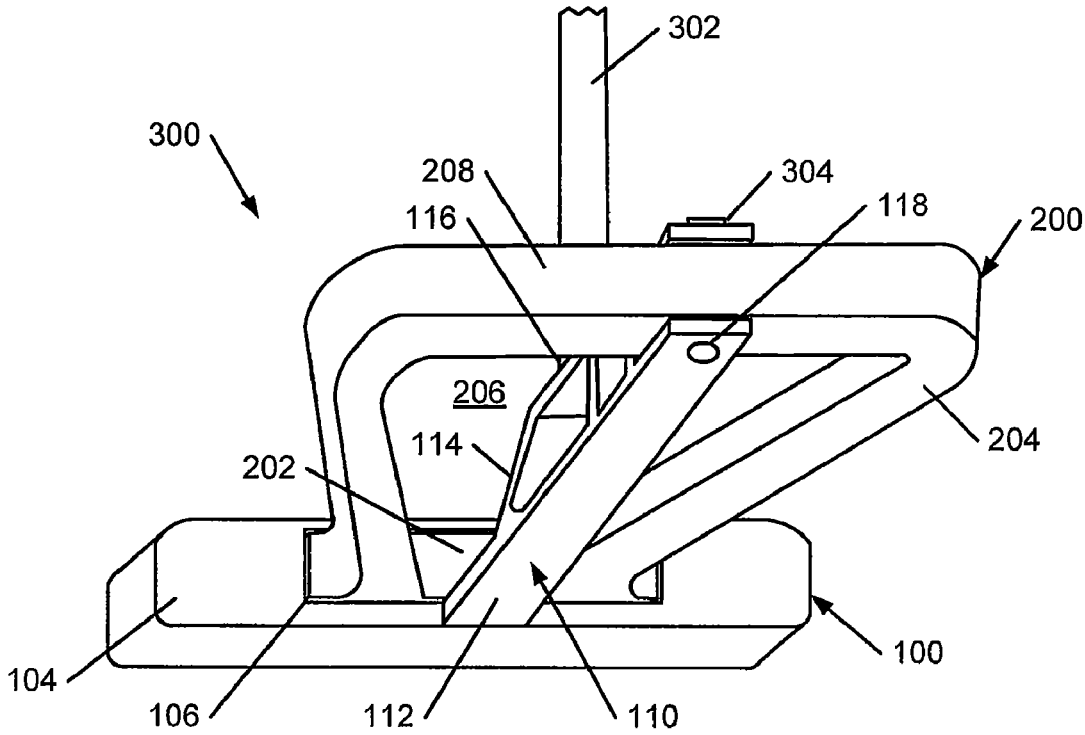
FIGS. 3 and 4 illustrate perspective views of a ball striking device including a body member and an insert member according to an example of this invention.
Figure 4:
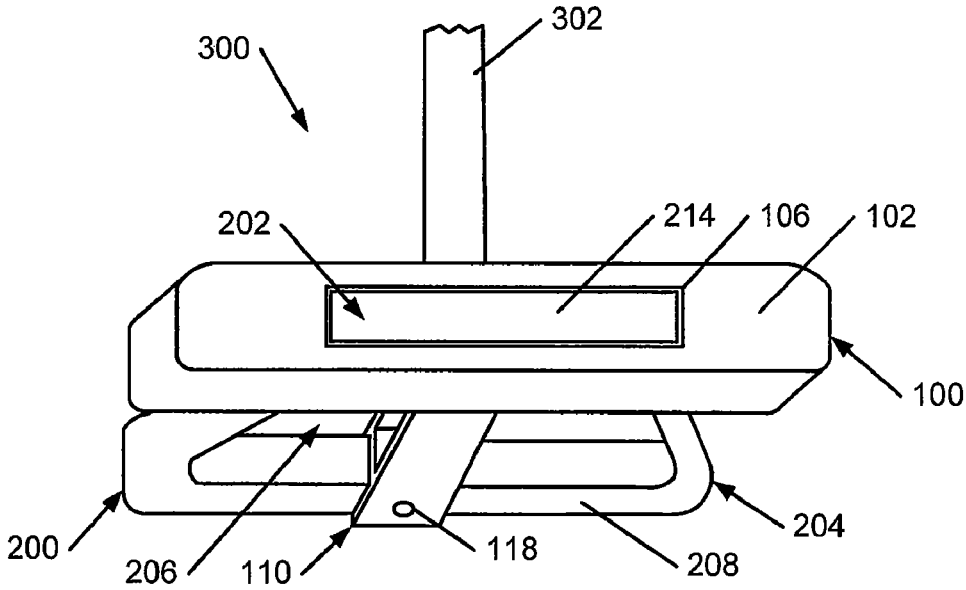

FIGS. 3 and 4 illustrate different perspective views of an example ball striking device 300 including the body member 100 and the insert member 200 as illustrated in FIGS. 1 and 2. As shown in FIG. 3, the insert portion 202 of the insert member 200 fits into the opening 106 provided in the back surface 104 of the body member 100. The flattened region 112 and the angled region 114 of the base member 110 provide sufficient room to allow insertion of the insert portion 202 into the opening 106. The insert member 200 and the body member 100 may be secured together at the insert portion 202/opening 106 location, if desired, in any desired manner without departing from the invention, including in conventional manners known in the art, such as via welding, adhesives, mechanical connections, or the like. If desired, the insert member 200 and the body member 100 may be secured together in a removable manner (e.g., via bolts, nuts, screws, set screws, clamps, clasps, or other mechanical connectors) without departing from the invention so that different parts of the overall device structure 300 can be interchanged, e.g., by a user, a club repair person, etc., e.g., to allow changes to the club's swing characteristics, to customize the club head to a user's preferences, to change the club head based on play conditions (e.g., fast greens v. slow greens, wet conditions v. dry conditions, etc.), etc. As an example, the insert member 200 and the body member 100 may be press fitted together at the insert portion 202/opening 106 (e.g., sized and shaped so as to tightly fit together) and/or mechanical attachments may be used to hold the pieces together, as will be described in more detail below, without permanently fixing the insert portion 202 into the opening 106. FIGS. 3 and 4 further illustrate a shaft or handle 302 mounted to the base member 110 at the shaft mounting region 116.

Still additional features present in structures according to some examples of the invention are shown in FIGS. 3 and 4. As shown in this example, the body member 100 and the insert member 200 may be secured to one another at a location where the base member 110 of the body member 100 meets the body portion 204 of the insert member 200. While any manner of securing these members 100 and 200 together may be used without departing from the invention, in the illustrated example, one or more bolts, screws, rivets 304, or other connectors pass through securing region 118 of body member 100 and through securing region 224 of insert member 200 (see also FIG. 2). Alternatively (or additionally), if desired, the base member 110 of the body member 100 may be secured to the body portion 204 of the insert member 200 by adhesives, welding, soldering, set screws, clamps, clasps, other mechanical connectors, and/or in any other manner without departing from the invention, including in conventional manners known in the art.

As further illustrated by FIG. 4, the opening 106 in this example structure extends all of the way through the body member 100, ending at the front surface 102 of the body member 100. Accordingly, when the insert member 200 is inserted into the opening 106 in this example structure, the front face 214 of the insert member 200 is exposed through the front surface 102 of the body member 100. In the illustrated example, the front surfaces 102 and 214 of the body member 100 and the insert member 200, respectively, are flush or substantially flush with one another in the final club head structure 300, and these surfaces 102 and 214 together form the ball striking surface of this example ball striking head.

Figure 5:
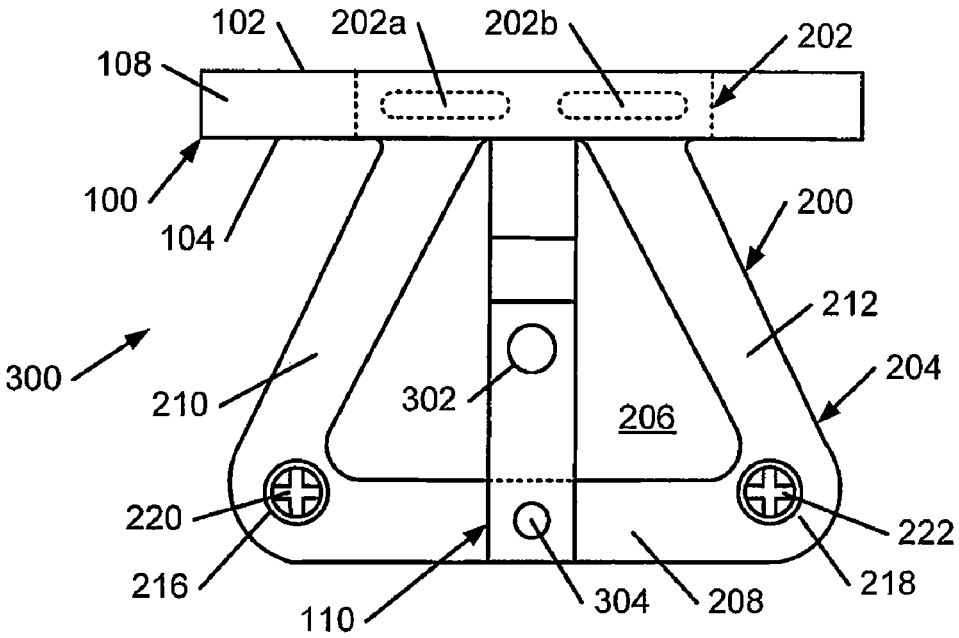
FIG. 5 illustrates an overhead view of a ball striking device including a body member and an insert member according to an example of this invention.

FIG. 5 illustrates an overhead view of the club head structure 300 shown in FIGS. 1-4. Various "hidden" features of the insert member 200 in this view are shown in broken lines to help provide a more complete picture of the club head structure 300 according to this example of the invention.

As generally described above, the combination of open areas in the club head structure (e.g., areas 120, 202*a*, 202*b*, 206, and the like) reduce the mass of the overall club head structure 300 and allow the club designer to place that mass at other locations in the design (e.g., using weighted members 220 and 222) and thereby change the swing characteristics of the club. In the example illustrated in FIGS. 1-5, much of this mass is redistributed at the outer regions of the club head (e.g., at the external corners or external perimeter of the triangular shaped insert member's body portion 204, between arms 210 and 212 and the base member 208). Using external weighting of a club head, e.g., of the type illustrated in FIGS. 1-5, the overall club head design (i.e., the combination of body member 100, insert member 200, and any weighted inserts) may be structured and weighted so that the club head will have a moment of inertia of at least 10,000 g/cm$^2$ about the center of the ball striking face 102 and 214. In some examples, the moment of inertia about the center of the ball striking face may be at least 11,000 g/cm$^2$, or even at least 12,000 g/cm$^2$. The moment of inertia provides a measure of a club head's (or other object's) resistance to twisting, e.g., both during a swing and/or during contact with an object to be hit (e.g., such as a golf ball). As described above, a twisted club head, either during a swing or during contact, will tend to send a ball off-line, with undesired spin, and/or miss the club's "sweet spot," e.g., resulting in a loss of distance. Therefore, the high moment of inertia associated with club head structures according to at least some examples of the invention may help prevent club head twisting and/or mis-hits.

Figure 6:
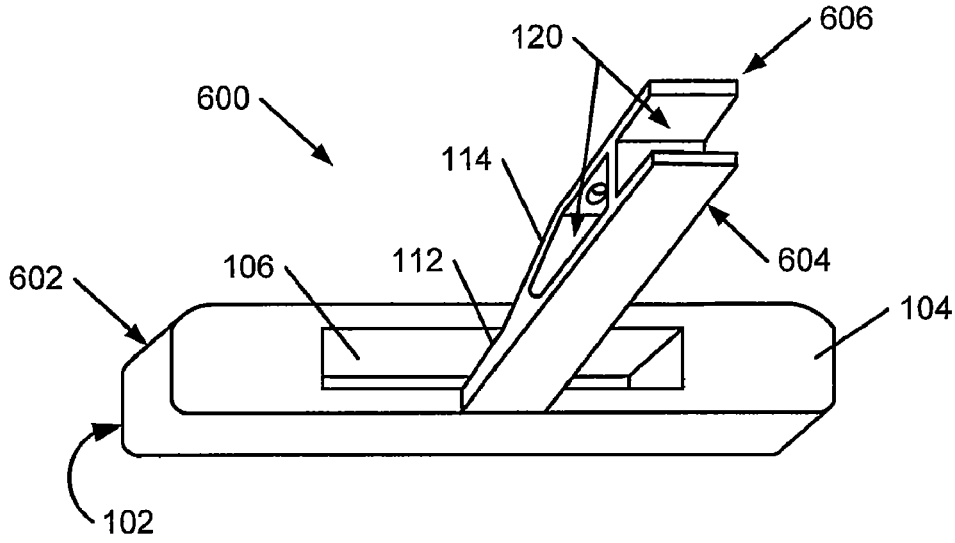
FIG. 6 illustrates a ball striking device body member according to another example of this invention.
Figure 7:
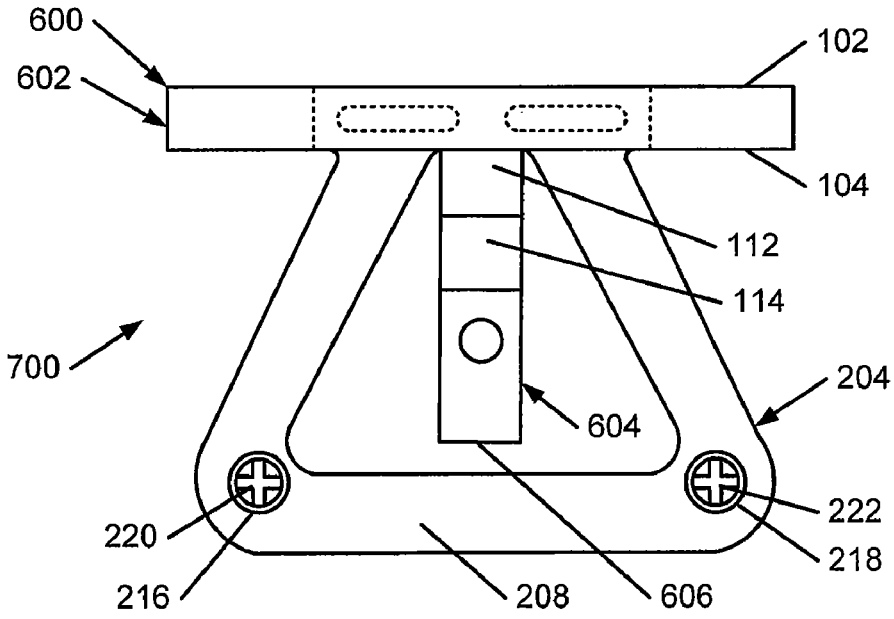
FIG. 7 illustrates an overhead view of a ball striking device including a body member and an insert member according to another example of this invention.

Of course, many variations in the design of the various parts of a ball striking device are possible without departing from the invention. FIGS. 6 and 7 illustrate another example embodiment of a ball striking device 700 that includes a body member 600 that differs from the body member illustrated in FIGS. 1 and 3-5. Specifically, in this example, while the ball striking portion 602 of the body member 600 is similar to the ball striking portion of the body member 100 shown in FIG. 1 (e.g., including front surface 102, back surface 104, and opening 106), the base member 604 in FIG. 6 differs from the base member 110 shown in FIG. 1. While base member 604 still includes flattened region 112, angled region 114, and open cell structures 120 like that illustrated in FIG. 1, base member 604 does not include a rearward connection to the insert member 200. Rather, as illustrated in FIG. 7, the rear portion 606 of base member 604 remains free and unconnected to insert member 200 (while any desired insert member structure may be used without departing from the invention, in the illustrated example, the insert member 200 of the example of FIG. 7 has a structure similar to that illustrated in FIGS. 2-5).

Figure 8:
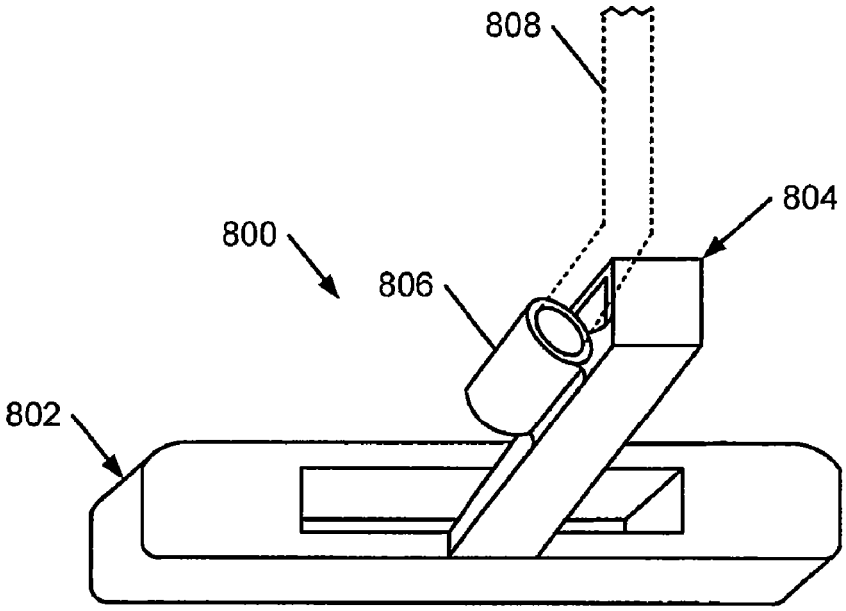
FIG. 8 illustrates a ball striking device body member according to another example of this invention.

FIG. 8 illustrates still another example of a body member 800 of a ball striking device according to examples of the invention that includes a ball striking portion 802 and a base member 804. While the overall structure of this body member 800 is similar to those included in FIGS. 1 and 6, this body member 800 differs in that a receptacle 806 for mounting a shaft or handle 808 is provided separate from and/or as an attachment to the base member 804. The shaft receptacle 806 may be included with the base member 804 (and/or other part of the club head structure) in any desired manner, such as part of a unitary, one-piece construction (e.g., during molding or casting), by welding, by adhesives, by mechanical connections, and the like. Additionally, the shaft 808 may be of any design or construction without departing from the invention, e.g., straight, bent, off-set, graphite, steel, etc. Furthermore, the shaft 808 may be attached to the receptacle 806 in any desired manner without departing from the invention, such as by welding, by adhesives, by mechanical connections, and the like. Any desired insert member construction or structure may be included in this body member 800 without departing from the invention, including the various examples of insert members 200 described above in connection with FIGS. 2-5. Additionally or alternatively, a shaft receptacle 806 or other shaft mounting system may be included as part of the insert member (e.g., member 200) without departing from the invention.

Figure 9:
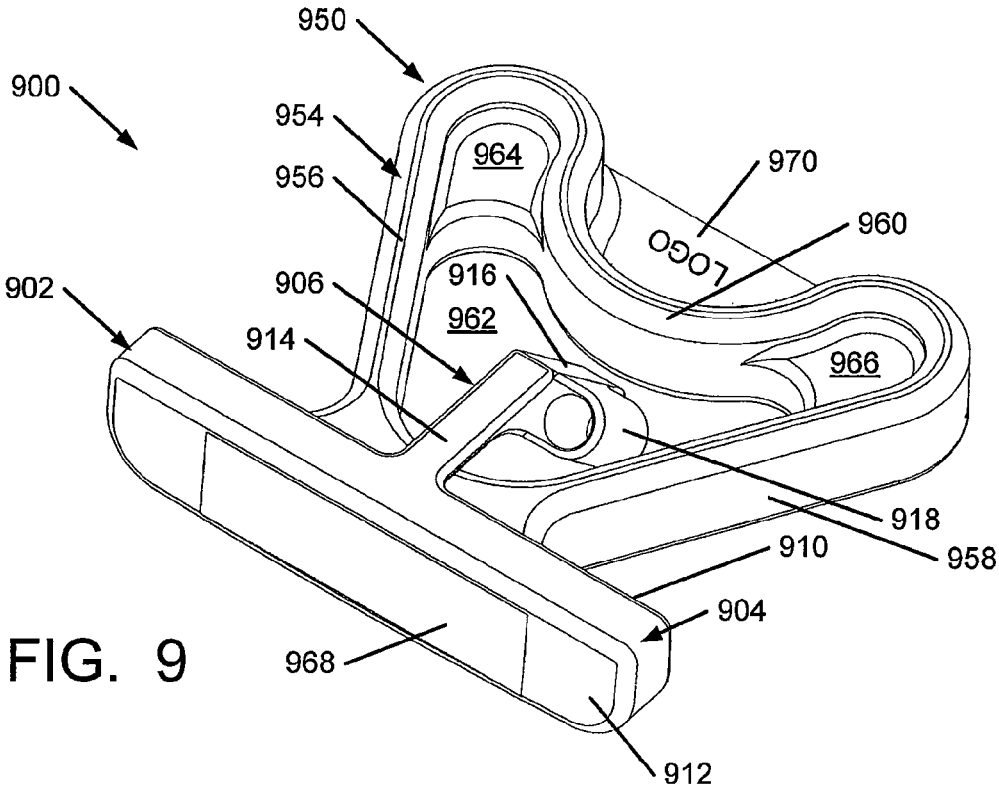
FIGS. 9 and 10 illustrate perspective views of another ball striking device including a body member and an insert member according to another example of this invention.
Figure 10:
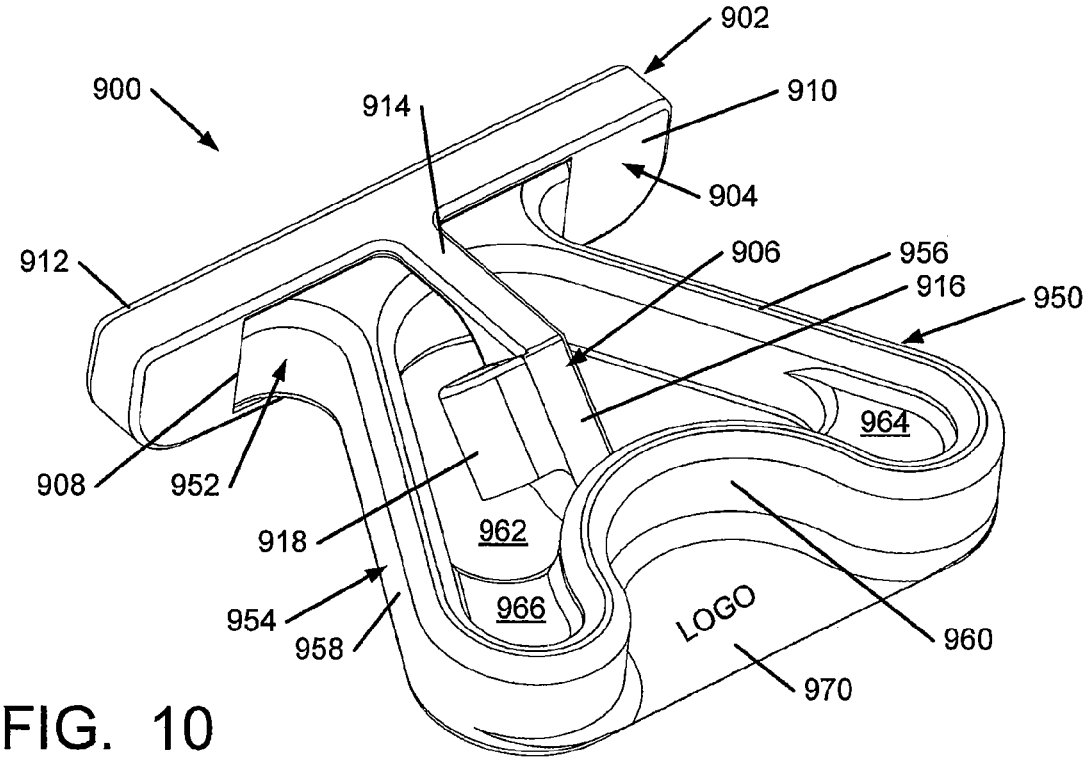

FIGS. 9 and 10 provide perspective views of another example embodiment of a ball striking device 900 in accordance with examples of this invention (e.g., a putter head). A body member 902 provides a ball striking portion 904 and a base member 906 extending away from the ball striking portion 904 (and toward the rear of the club structure 900). An opening 908 is defined in the rear surface 910 of the ball striking portion 904, and this opening 908 extends from the rear surface 910 through to the front surface 912, which faces the ball during use. If desired, of course, the opening 908 could begin at rear surface 910 and extend part way through the ball striking portion 904 of body member 902 but terminate before it reaches the front surface 912. As another example, if desired, the opening 908 may be provided in another surface of the ball striking portion 904, or not at all, without departing from the invention. Also, if desired, the ball striking portion 904 need not take on the generally cubic rectangular form in all examples of the invention.

The base member 906 of this example includes a flattened portion 914 and an angled portion 916 to allow room for insertion of an insert member 950 into the opening 908, which will be described in more detail below. A shaft or handle receptacle 918 is provided along the angled portion 916 of the base member 906, in an off-set manner. Of course, this shaft or handle receptacle 918, or other shaft mounting means, may be provided at any desired location or in any desired orientation without departing from the invention. Additionally or alternatively, the shaft or handle may be mounted to the ball striking device 900 at any desired location on the structure (including on the insert member 950 or on both the body member 902 and the insert member 950) without departing from the invention.

Insert member 950 includes an insert portion 952 and a body portion 954. The insert portion 952 is inserted into the opening 908 of the body member 902, and the body portion 954 extends in a direction rearward and away from the ball striking portion 904. In this example, the base member 906 of the body member 902 does not attach to the body portion 954, although the body member 902 may be attached to the insert member 950 at the insert portion 952/opening 908 interface) (e.g., using adhesives, welding, set screws, bolts, clamps, clasps, other mechanical connectors, a tight friction fit, press fitting, etc.). Optionally, the body member 902 and the insert member 950 may be removably attached to one another such that repairs may be made, the swing characteristics of the overall club head 900 may be changed, etc., e.g., by interchanging body members 902 and insert members 950. This feature may allow users to freely customize the club by interchanging body members 902 and/or insert members 950, e.g., to suit their swing characteristics or preferences, to match play conditions (e.g., fast greens v. slow greens, wet conditions v. dry conditions, etc.), etc.

In this illustrated example, the body portion 954 of insert member 950 is generally triangular shaped, with two side arms 956 and 958 and a base side 960. The body portion 954 has a reduced weight area, in this example embodied as an open area 962 defined in the body portion. Additional weighted areas 964 and 966 are provided at the corner regions of the triangular base structure (i.e., where the base side 960 meets the two side arms 956 and 958), to thereby re-distribute weight (e.g., from the open area 962) to the rear perimeter of the club head structure. Rather than providing selectively removable weighted members (like those shown in FIGS. 2-5), in this example of the invention, the weighted areas 964 and 966 are provided by not extending the open area 962 all the way to the corners of the triangular structure (e.g., at least some of the metal, polymeric, or other structural material of the body portion 954 is left at the areas of the body portion remote from the ball striking portion 904). If desired, additional weights may be fitted and received in the existing weighted areas 964 and 966, optionally in a selectively removable manner, without departing from the invention. The additional weights, if present, may be in the form of metal inserts (e.g., lead, tungsten, etc.), weighted adhesive (e.g., lead tape), or any other form without departing from the invention.

As shown in FIG. 9, the front surface 968 of the insert member 950 is exposed through the opening 908 and forms at least a part of the ball striking surface of the overall ball striking device 900. While the front surface 968 of the insert member 950 and the front surface 912 of the body member 902 are shown flush (or substantially flush) in this illustrated example (and together form the ball striking face of the ball striking device 900), if desired, these surfaces need not be flush. For example, if desired, the front surface 968 of the insert member 950 may extend out of the opening 908 and in front of the front surface 912 of the body member 902 (e.g., such that the front surface 968 exclusively forms the ball striking face of the ball striking device 900). Various sizes of front surface 968 exposed through the opening 908 (if any) may be used without departing from the invention.

The ball striking device 900 of this example includes additional features. For example, as illustrated, the base side 960 is curved and provides an indicia area 970. These features provide an interesting aesthetic design to the device 900. Additionally, if desired, a club maker, manufacturer, or another may provide a logo, model name, model number, owner's name, and/or other indicia or data in the indicia area 970.

The ball striking device 900 of FIGS. 9-10 also differs from the examples illustrated in FIGS. 1-8 in that the base member 906 of the body member 902 extends from the top of the ball striking head 904, rather than its bottom. Thus, the flattened area 914 of the base member 906 extends away from the ball striking surface 912 and the insert member 950 fits underneath the base member 906. This structural change also results in the angled portion 916 and the handle mount 918 extending in different directions as compared to the angled portions and handle mounts described above in conjunction with FIGS. 1-8. Of course, the base member 906 may be provided at other locations, including beneath opening 908, along side opening 908, and/or elsewhere, without departing from the invention. Numerous other structural modifications and the like are possible without departing from the invention.

Additional aspects of the invention relate to methods for assembling or constructing a ball striking device such as a golf club head and/or an entire golf club. While the following methods will be described in conjunction with construction of putters and putter heads, like those illustrated in conjunction with FIGS. 1-5, those skilled in the art will appreciate that methods in accordance with examples of the invention may be practiced to produce other ball striking devices, including putter and golf club head designs that differ from the specific examples illustrated in this application.

One example method according to the invention includes providing a body member 100 for a ball striking device that includes a first surface 102 that faces a ball in use, a second surface 104 that defines an opening 106, and a base member 110 extending in a direction away from the first surface 102 (e.g., toward the rear of the overall ball striking device when constructed). An insert portion 202 of an insert member 200 is inserted into the opening 106 defined in the body member 100. The insert member 200, as described above, further may include a body portion 204 that extends in a direction away from the insert portion 202. This body portion 204 may be structured and constructed so as to define at least one open area 206. The body member 100 may be secured with the insert member 200, e.g., at the insert portion 202/opening 106 interface, at a securing region 118 and 224, and/or in any desired manner. This securing may include use of adhesives, welding, clamps, clasps, screws, bolts, set screws, other mechanical connectors, press fitting, or the like.

Additional features of methods of the invention relate to changing the swing characteristics of the ball striking device. Anyone may make these changes without departing from the invention, such as the club designer, the club manufacturer, a profession club fitter, a user of the ball striking device, etc. Such methods may include attaching one or more weighted members (e.g., members 220, 222) to the club head, e.g., at a rear and/or an exterior portion or perimeter of the body member 100 or the insert member 200, so as to increase the moment of inertia about the center of the ball striking face of the ball striking device head. This high moment of inertia helps prevent the club head from twisting, e.g., during a swing and/or at contact with the ball.

In at least some example methods, weighted members 220 and 222 may be fit into receptacles 216 and 218, respectively, provided in the base side 208 of the body portion 204 of the insert member 200 (e.g., at corner regions of the triangular structure associated with this example body portion 204). These receptacles 216 and 218 and their associated weighted members 220 and 222 may be designed to enable selective removable and/or replacement of the weighted members 220 and 222, e.g., to customize the club head's swing characteristics for a given user's swing and/or preferences (e.g., to give the club head the moment of inertia characteristics described above). Of course, as noted above, various designs of weighted members, receptacles, and the like may be used without departing from the invention. Optionally, if the weighted member or members include lead tape or other adhesively adhered weighted member structures (or the like), receptacles and/or other mechanical connectors may not be necessary in the ball striking device structure.

Still additional features for customizing the club head may be available according to examples of the invention. For example, the insert members 200 may be removable from the body members 100 and replaceable by new insert members (or vice versa), e.g., tom make new combinations of insert members 200 and body members 100 having different weighting, different weight distribution, different ball rebound or other striking characteristics, different sounds, etc. In this manner, users can further customize the club head to match their swing characteristics, preferences, play conditions, and the like, as described above.

Other elements also may be included in the ball striking device structure without departing from the invention. For example, further methods according to examples of the invention may include attaching a handle or shaft member 302 to at least one of the body member 100 or the insert member 200.

Figure 11:
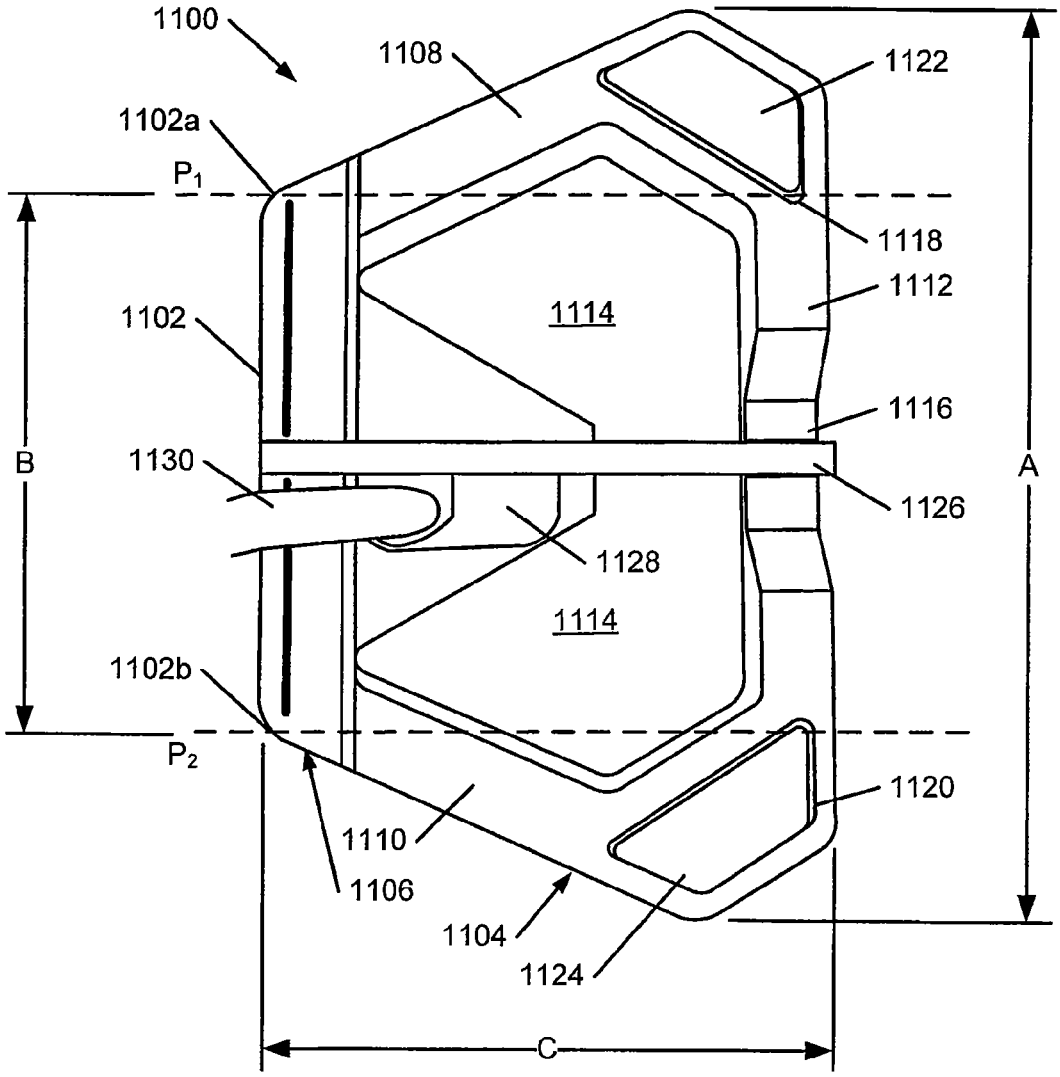
FIG. 11 illustrates an overhead view of another ball striking device according to another example of this invention.

FIG. 11 illustrates another example of a ball striking device structure according to aspects of this invention. In this example structure, the ball striking device is in the form of a golf club putter head 1100 that includes a ball striking front surface 1102 and a body member 1104 extending in a direction away from the ball striking surface 1102. Golf club heads according to this aspect of the invention may have a moment of inertia about a center of the ball striking surface 1102 of at least 20,000 g/cm$^2$, and in at least some examples the moment of inertia will be at least 25,000 g/cm$^2$, and even at least 28,000 g/cm$^2$ in some examples.

The material that makes up all or at least some portions of the golf club head 1100 may help provide the moment of inertia features described above. For example, all or at least some of the body portion 1104 may be made of a lightweight material, such as a lightweight polymeric material (e.g., a polyamide or nylon material), a lightweight metal material (e.g., aluminum or titanium), and the like. In at least some examples, the body portion 1104 and the ball striking portion 1106 of the club head (e.g., the portion of the club head including the ball striking surface 1102) may be integrally formed as a unitary, one-piece construction, e.g., from a polymeric or other lightweight material as described above. If desired, however, the body portion 1104 may be designed as an insert that fits into one or more openings provided in the ball striking portion 1106, as described above in more detail in conjunction with FIGS. 1-10. As still another option, the body portion 1104 may be attached to a separate ball striking portion 1106 in any desired manner without departing from the invention (e.g., using adhesives, mechanical connectors, welding, etc.). If desired, the ball striking portion 1106 may be made of a different material as compared to the body portion 1104 without departing from this invention.

The ball striking front surface 1102 may take on various forms without departing from the invention. For example, the ball striking surface 1102 may be integrally formed as simply the front-most surface of the ball striking portion 1106. As another alternative, the ball striking surface 1102 may be a metal plate or other material that is attached to the front of the ball striking portion 1106, e.g., using adhesives, screws, or other mechanical connectors. As still another option, the ball striking surface 1102 and/or the ball striking portion 1106 may be integrally formed as a unitary, one-piece construction with the remainder of the body portion 1104 without departing from the invention. As yet another option, at least a portion of the ball striking surface 1102 may be provided as an insert portion attached to or formed as part of the body member 1104 that is inserted into an opening defined in the ball striking portion 1106, as generally described above in connection with FIGS. 1-10. Other desired ways of providing the ball striking surface 1102 may be utilized without departing from this invention.

Additional features of the structure of the club head 1100 help produce the moment of inertia characteristics described above. For example, the body member 1104 may be designed so as to extend behind and outside the ball striking surface 1102. For example, side arms 1108 and 1110 of the body member 1104 extend back and outside of the ball striking portion 1106. The body member 1104 further includes a base member 1112 that extends behind the ball striking portion 1106, in a manner parallel to (or essentially parallel to) the ball striking surface 1102. Thus, the overall club head structure 1100 has a generally trapezoidal or triangular face (depending on the location where the arms 1108 and 1110 meet the ball striking portion 1106), with an open area 1114 defined in its center. The arms 1108 and 1110 are illustrated as being thinner than the ball striking portion 1106 (into and out of the page of FIG. 11), and the base member 1112 has an even thinner portion 1116. These reduced sizes, as well as the open area 1114, help reduce the overall weight of the body member 1104 (and optionally make that weight available for redistribution elsewhere in the club head structure 1100, as will be described in more detail below). If desired, the arms 1108 and 1110 and/or the base member 1112 may be hollowed out and/or produced in a "truss-like" manner, to further reduce their weight (and to further make that weight available for redistribution elsewhere).

In at least some examples of the invention, the club head 1100 will be relatively large sized, e.g., at or near the limits permitted by current USGA regulations and guidelines. Currently, the USGA guidelines limit putter head designs to: (a) a maximum overall width (e.g., dimension "A" in FIG. 11) of seven inches ($A \leqq 7$ inches); (b) a maximum overall depth (e.g., dimension "C" in FIG. 11) of less than dimension "A" ($A > C$); (c) a minimum face width (e.g., dimension "B" in FIG. 11) of at least ⅔ of dimension "C" and at least ½ of dimension "A" ($B \geqq \frac{2}{3} C$ and $B \geqq \frac{1}{2} A$); and (d) a maximum overall height (e.g., into and out of the page of FIG. 11) of 2.5 inches.

In this illustrated example, the body member 1104 includes a pair of weighted member receptacles 1118 and 1120 located behind the ball striking surface 1102 and at least partially outside of this surface 1102. More specifically, at least some portions of the weighted member receptacles 1118 and 1120 are located outside of a plane oriented perpendicular to the ball striking surface 1102 and located at the respective ends 1102*a* and 1102*b* of the ball striking surface 1102 (see planes $P_1$ and $P_2$ in FIG. 11). If desired, in at least some examples, the entire weighted member receptacles 1118 and 1120 may be located outside of these planes without departing from the invention. Weighted members 1122 and 1124 (e.g., lead, tungsten, or other heavy material inserts) may be inserted in the receptacles 1118 and 1120, respectively, to provide extra weighting behind and generally at the outer perimeter of the club head structure 1100. Thus, at least some portions (or all) of the weighted members 1122 and 1124 also are located outside of the planes $P_1$ and $P_2$ described above.

The example structure 1100 illustrated in FIG. 11 further includes a base portion 1126 extending away from the ball striking surface 1102 and toward the rear of the club head structure 1100. This base portion 1126 may be provided at the very center of the ball striking surface 1102, and thereby may act as an alignment aid for the putter head structure 1100 (e.g., identifying the "sweet spot" of the club head). The base portion 1126 may extend from and/or attach to the ball striking portion 1106 and/or the body portion 1104 in any desired manner without departing from the invention. For example, the base portion 1126 may be attached to one or more of the body portion 1104, the ball striking surface 1102, and/or the ball striking portion 1106, e.g., via adhesives, welding, soldering, mechanical connectors, and the like. As another example, the base portion 1126 may be integrally formed as a unitary one-piece construction with the body portion 1104, the ball striking surface 1102, and/or the ball striking portion 1106, optionally made from the same materials as one or more of these elements, without departing from the invention.

The club head structure 1100 further may include a shaft mounting member 1128 to which a shaft 1130 is mounted, e.g., in any desired manner, including in conventional manners known in the art. Any desired type of shaft 1130 may be used without departing from the invention, including shafts 1130 of conventional design and made of conventional materials.

The desire to hit balls or other objects square, straight, and true is not limited to golf. For example, aspects of the invention advantageously may be used in forming mallets used in polo or croquet; hockey sticks (field hockey or ice hockey); tennis or badminton rackets; cricket bats; and the like. More generally, aspects of the invention advantageously may be used in any sporting equipment in which a bat or club-like element is swung and there is a desire to maintain a square line to a target path with little or no twist of the club head during the swing and/or at contact.

D. Conclusion

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A method, comprising:

providing a first member including a first surface that faces a ball in use, a second surface opposite the first surface, wherein an opening is defined in the second surface, and a base member extending in a direction away from the first surface;

inserting an insert portion of a second member into the opening defined in the first member such that the insert portion is exposed through the first surface of the first member and a surface of the insert portion of the second member forms at least a portion of a ball striking surface, wherein the second member further includes a body portion that extends in a direction away from the insert portion, wherein the body portion defines and encloses at least one exposed open area, and wherein, after the inserting is complete, at least some of the body portion of the second member remains outside the first member and extends rearwardly from the second surface of the first member to define and enclose the at least one exposed open area behind the second surface of the first member, and securing the first member and the second member to one another.

2. A method according to claim 1, wherein the insert portion of the second member is inserted into the opening defined in the first member such that the insert portion is surrounded by the first member between the first surface and the second surface.

3. A method according to claim 1, wherein the body portion of the second member is triangular shaped, wherein an interior portion of the triangular shaped body portion defines the open area.

4. A method according to claim 3, further comprising:

attaching a first weighted member at a first corner region of the body portion; and attaching a second weighted member at a second corner region of the body portion.

5. A method according to claim 1, further comprising:

attaching a weighted member to the body portion of the second member.

6. A method according to claim 1, further comprising:

attaching a weighted member to the body portion of the second member.

7. A method according to claim 1, wherein the securing includes securing the base member of the first member to the body portion of the second member.

8. A method according to claim 1, wherein the method produces a golf club head.

9. A method according to claim 1, wherein the method produces a putter head.

10. A method, comprising:

providing a first member including a first surface that, at least in part, defines a ball striking surface that faces a ball in use; and securing a second member with the first member, wherein an opening is defined in the first member, and an insert portion of the second member is received in the opening, wherein the second member includes a body portion that extends in a direction away from the first member, wherein the body portion defines and encloses at least one exposed open area, wherein the body portion of the second member is triangular shaped, and wherein a base side of the triangular shaped body portion extends parallel or substantially parallel to the first surface of the first member, wherein the first member and the second member, at least in part, form a ball striking device, wherein the ball striking device includes a ball striking head that includes the ball striking surface, wherein the ball striking head has a moment of inertia about a center of the ball striking surface of at least 10,000 g-cm$^2$.

11. A method according to claim 10, wherein the moment of inertia is at least 11,000 g-cm$^2$.

12. A method according to claim 10, wherein the moment of inertia is at least 12,000 g-cm$^2$.

13. A method according to claim 10, further comprising:

inserting an insert portion of the second member into an opening defined in the first member.

14. A method according to claim 13, wherein the opening in the first member extends through the first member such that the insert portion of the second member is exposed through the first surface of the first member.

15. A method according to claim 10, further comprising:

attaching a first weighted member at a first corner region of the body portion; and attaching a second weighted member at a second corner region of the body portion.

16. A method according to claim 10, further comprising: attaching a weighted member to the body portion of the second member.

17. A method according to claim 10, wherein the first member includes a base member extending in a direction away from the first surface, and wherein the securing includes securing the base member to the body portion of the second member.

18. A method according to claim 10, wherein the method produces a golf club head.

19. A method according to claim 10, wherein the method produces a putter head.

* * * * *